US007014723B2

(12) United States Patent
Beck et al.

(10) Patent No.: US 7,014,723 B2
(45) Date of Patent: Mar. 21, 2006

(54) NICKEL-BASE ALLOY

(75) Inventors: Cyril Gerard Beck, Greenville, SC (US); John Herbert Wood, St. Johnsville, NY (US); Stephen Daniel Graham, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 438 days.

(21) Appl. No.: 10/065,225

(22) Filed: Sep. 26, 2002

(65) Prior Publication Data

US 2005/0244296 A1 Nov. 3, 2005

(51) Int. Cl.
*C22C 19/05* (2006.01)

(52) U.S. Cl. ..... 148/428; 148/410; 420/447; 420/448; 420/449

(58) Field of Classification Search ..... 148/410, 148/428; 420/447, 448, 449
See application file for complete search history.

(56) References Cited

U.S. PATENT DOCUMENTS 4,140,555 A * 2/1979 Garcia et al. ..... 148/428
4,219,592 A * 8/1980 Anderson et al. ..... 427/405
4,810,467 A 3/1989 Wood et al. ..... 420/448
4,981,644 A * 1/1991 Chang ..... 420/442
6,258,317 B1 * 7/2001 Smith et al. ..... 420/448

FOREIGN PATENT DOCUMENTS

JP 61-73853 * 4/1986 ..... 420/448

* cited by examiner

*Primary Examiner*—John P. Sheehan
(74) *Attorney, Agent, or Firm*—Ernest Cusick; Gary M. Hartman; Domenica N.S. Hartman

(57) ABSTRACT

Castable and weldable nickel-base alloys that exhibit a desirable balance of strength and resistance to corrosion and oxidation suitable for gas turbine engine applications. The alloy contains, by weight, about 10% to about 25% cobalt, about 20% to about 28% chromium, about 1% to about 3% tungsten, about 1.6% to about 3.8% aluminum, about 0.4% to about 1.5% titanium, where the sum of aluminum and titanium is about 1.8% to about 5.0%, about 0.5% to about 1.5% columbium, 0.5% to about 1.5% tantalum, about 0.001% to about 0.025% boron, about 0.05% maximum zirconium, about 0.02% to about 0.15% carbon, with the balance essentially nickel and incidental impurities. The alloy may more preferably contain about 2.8% to about 3.8% aluminum where the sum of aluminum and titanium is about 3.0% to about 5.0%, or about 1.6% to about 2.8% aluminum, where the sum of aluminum and titanium is about 1.8% to about 4.3%.

20 Claims, 1 Drawing Sheet

NICKEL-BASE ALLOY

BACKGROUND OF INVENTION

1. Field of the Invention

The present invention generally relates to nickel-base alloys. More particularly, this invention relates to castable and weldable nickelalloys exhibiting desirable properties suitable for gas turbine engine applications.

2. Description of the Related Art

The superalloy GTD-222 (U.S. Pat. No. 4,810,467) has a number of desirable properties for gas turbine engine applications, such as nozzles (vanes) in the latter (second and third) stages of the turbine section. The nominal composition of GTD-222 is, by weight, about 19% cobalt, about 22.5% chromium, about 2% tungsten, about 1.2% aluminum, about 2.3% titanium, Al+Ti of about 3.5%, about 0.8% columbium (niobium), about 1.0% tantalum, about 0.01% boron, about 0.01% zirconium, about 0.1% carbon, with the balance essentially nickel and incidental impurities. As with the formulation of other nickelalloys, the development of GTD-222 involved careful and controlled adjustments of the concentrations of certain critical alloying elements to achieve a desired mix of properties. For use in turbine nozzle applications, such properties include high temperature strength, castability, weldability, and resistant to low cycle fatigue, corrosion and oxidation. Unfortunately, when attempting to optimize any one of these desired properties, other properties are often adversely affected. A particular example is weldability and creep resistance, both of which are of great importance for gas turbine engine nozzles. However, greater creep resistance results in an alloy that is more difficult to weld, which is necessary to allow for repairs by welding.

A desirable combination of creep strength and weldability exhibited by GTD-222 is believed to be the result of the use of judicious levels of aluminum, titanium, tantalum and columbium in the alloy. Each of these elements participates in the gamma prime (γ') precipitation-strengthening phase ($Ni_3(Ti,Al)$). Aluminum and titanium are the key elements in the formation of the gamma-prime phase, while the primary role of tantalum and columbium is to participate in the MC carbide phase. Tantalum and columbium remaining after MC carbide formation plays a lesser but not insignificant role in the formation of the gamma-prime phase.

As noted above, GTD-222 is well suited for use in latter stage gas turbine engine nozzle applications. However, the thermal environment of second stage nozzles can be sufficiently severe to require an oxidation-resistant coating, a thermal barrier coating (TBC), and/or internal cooling. The properties of GTD-222 are sufficient to allow third stage nozzles to achieve the required design life without such additional measures. However, the third stage nozzles of some engine applications do not require the strength of GTD-222. In view of these differences, it would be desirable if alloys were available that were more closely matched to the properties required for second and third stage nozzles of gas turbine engines.

SUMMARY OF INVENTION

The present invention provides alloys that exhibit a desirable balance of strength (creep resistance) and resistance to corrosion and oxidation suitable for nozzles of the latter stages of a gas turbine engine. More particularly, the alloys have properties tailored for either the more demanding operating environment of a second stage nozzle, or the less severe operating environment of a third stage nozzle. The alloys are also castable, relatively easy to weld in order to satisfy repair demands, substantially immune to metallurgical instability, and have heat treatment requirements typical for nickel-base superalloys. These desirable properties are achieved with nickelalloys having carefully controlled amounts of precipitation hardening elements different from the GTD-222 alloy, for which these alloys are advancements, as well as controlled amounts of other elements generally in accordance with the GTD-222 alloy.

A castable weldable nickelalloy in accordance with the present invention contains, by weight, about 10% to about 25% cobalt, about 20% to about 28% chromium, about 1% to about 3% tungsten, about 1.6% to about 3.8% aluminum, about 0.4% to about 1.5% titanium, where the sum of aluminum and titanium is about 1.8% to about 5.0%, about 0.5% to about 1.5% columbium, 0.5% to about 1.5% tantalum, about 0.001% to about 0.025% boron, about 0.05% maximum zirconium, about 0.02% to about 0.15% carbon, with the balance essentially nickel and incidental impurities. In addition, the alloy contains about 22 to about 43 volume percent of a gammaprecipitate phase.

According to a first aspect of the invention, the nickelalloy contains, by weight, about 2.8% to about 3.8% aluminum, and the sum of aluminum and titanium is about 3.0% to about 5.0%. This alloy more preferably consists essentially of, by weight, about 18.5% to about 19.5% cobalt, about 22.2% to about 22.8% chromium, about 1.8% to about 2.2% tungsten, about 3.0% to about 3.5% aluminum, about 0.55% to about 0.75% titanium, where the sum of aluminum and titanium is about 3.6% to about 4.2%, about 0.7% to about 1.45% columbium, 0.9% to about 1.1% tantalum, about 0.005% to about 0.015% boron, about 0.005% to about 0.020% zirconium, about 0.04% to about 0.10% carbon, with the balance essentially nickel and incidental impurities. An alloy having the above composition is particularly suitable in terms of creep strength, metallurgical stability and oxidation resistance for use in second stage turbine nozzle applications.

According to a second aspect of the invention, the nickelalloy contains, by weight, about 1.6% to about 2.8% aluminum, and the sum of aluminum and titanium is about 1.8% to about 4.3%. This alloy more preferably consists essentially of, by weight, about 18.5% to about 19.5% cobalt, about 22.2% to about 22.8% chromium, about 1.8% to about 2.2% tungsten, about 2.0% to about 2.4% aluminum, about 0.55% to about 0.75% titanium, where the sum of aluminum and titanium is about 2.5% to about 3.2%, about 0.7% to about 1.45% columbium, 0.9% to about 1.1% tantalum, about 0.005% to about 0.015% boron, about 0.005% to about 0.020% zirconium, about 0.04% to about 0.10% carbon, with the balance essentially nickel and incidental impurities. Such an alloy exhibits levels of creep strength and other properties suitable for use in third stage turbine nozzle applications.

The benefits described above are believed to be achieved by adjusting the ratios of the hardening alloy elements, namely, aluminum and titanium. Other advantages of the alloys of this invention include castability, weldability and relatively uncomplicated heat treatment requirements, which render the alloys suitable for a variety of high temperature applications in addition to nozzle applications. These additional advantages are also believed to be due in part to adjusting the ratios of the hardening alloy elements, as well as limiting the amount of carbon in the alloys.

Other objects and advantages of this invention will be better appreciated from the following detailed description.

DETAILED DESCRIPTION

Figure 1:
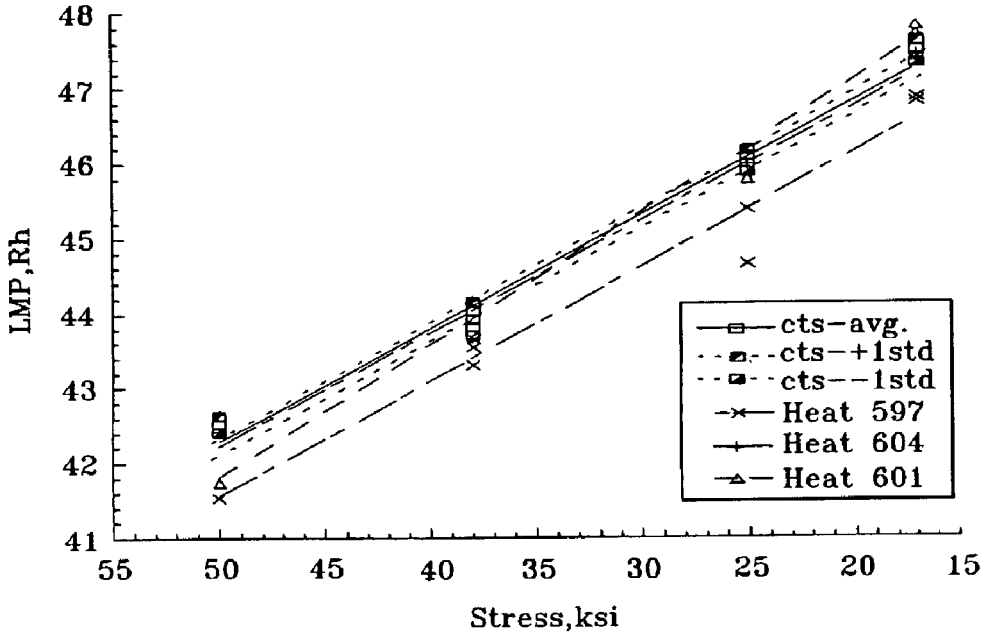
FIG. 1 is a graph plotting the Larson-Miller Parameter versus stress for alloys evaluated during an investigation leading to the present invention.

The present invention was the result of an effort to develop nickel-base alloys having chemistries that are carefully balanced to yield desirable levels of creep strength, metallurgical stability and weldability, while also substantially maintaining or improving such properties as oxidation resistance and castability relative to the nickelalloy commercially known as GTD-222 and disclosed in U.S. Pat. No. 4,810,467, which is incorporated herein by reference. The investigation resulted in the development of nickel-base alloys whose properties are particularly desirable for nozzles used in the second or third turbine stages of a gas turbine engine. The approach of the investigation was to radically alter the levels of minor alloying elements of GTD-222 that effect the gamma-prime precipitation hardening phase. In the investigation, various levels of aluminum and tantalum were evaluated to determine their effect on oxidation resistance and metallurgical stability, the latter of which is characterized by a reduced propensity for precipitation of the eta (η) phase ($Ni_3Ti$). The intent was also to alter carbon and titanium levels in an effort to reduce carbide and eta phase formation for the purpose of improving stability and weldability. Another aspect of the investigation was to alter the levels of aluminum and tantalum to expand and contract the volume fraction of gamma prime for the purpose of adjusting creep resistance at elevated temperatures.

The highstrength of a nickelsuperalloy is directly related to the volume fraction of the gammaphase, which in turn is directly related to the total amount of the gamma primeelements (aluminum, titanium, tantalum and columbium) present. Based on these relationships, the amounts of these elements required to achieve a given strength level can be estimated. The compositions of the gammaphase and other secondary phases such as carbides and borides, as well as the volume fraction of the gammaphase, can also be estimated based on the starting chemistry of the alloy and some basic assumptions about the phases which form. By such a procedure, it was concluded that an alloy having the desired level of creep strength for second stage nozzles should contain about 28 to about 32 volume percent of the gammaphase, while third stage nozzles could have a gamma-prime content of about 31 to about 36 volume percent.

Eight alloys having the approximate chemistries set forth in Table I below were formulated and cast during the investigation. Castings of the GTD-222 alloy were also prepared having the following approximate chemistry, by weight: 19% cobalt, about 22.5% chromium, about 2% tungsten, about 1.2% aluminum, about 2.3% titanium, about 0.8% columbium, about 1% tantalum, about 0.008% boron, about 0.022% zirconium, about 0.10% carbon, with the balance essentially nickel and incidental impurities. All of the specimens were in slab form prepared by a conventional investment casting technique. No differences were noted in castability between the different alloys. Each specimen underwent a standard heat treatment cycle developed for GTD-222, including a solution heat treat at about 2100° F. (about 1150° C.) for about four hours in a vacuum, followed by a rapid quench to below about 1300° F. (about 700° C.). All specimens then underwent aging at about 1475° F. (about 800° C.) for about eight hours.

TABLE I

| | Alloy No. 597 | Alloy No. 599 | Alloy No. 600 | Alloy No. 601 | Alloy No. 602 | Alloy No. 603 | Alloy No. 604 | Alloy No. 624 |
|---|---|---|---|---|---|---|---|---|
| Co | 19.0 | 19.0 | 19.0 | 19.0 | 19.0 | 19.0 | 19.0 | 19.0 |
| Cr | 22.5 | 22.5 | 22.5 | 22.5 | 22.5 | 22.5 | 22.5 | 22.5 |
| W | 2.0 | 2.0 | 2.0 | 2.0 | 2.0 | 2.0 | 2.0 | 2.0 |
| Al | 2.22 | 2.25 | 2.78 | 3.25 | 2.22 | 3.16 | 2.21 | 2.21 |
| Ti | 0.65 | 0.61 | 0.65 | 0.65 | 0.65 | 0.64 | 1.20 | 0.63 |
| Al + Ti | 2.87 | 2.86 | 3.43 | 3.90 | 2.87 | 3.80 | 3.41 | 2.84 |
| Cb | 0.8 | 0.8 | 0.8 | 0.8 | 0.8 | 0.8 | 0.8 | 0.8 |
| Ta | 1.00 | 2.52 | 1.01 | 1.00 | 1.00 | 1.00 | 1.00 | 1.77 |
| B | 0.005 | 0.005 | 0.005 | 0.005 | 0.005 | 0.005 | 0.005 | 0.005 |
| Zr | 0.01 | 0.01 | 0.01 | 0.01 | 0.01 | 0.01 | 0.01 | 0.01 |
| C | 0.06 | 0.06 | 0.06 | 0.06 | 0.07 | 0.08 | 0.06 | 0.09 |
| Ni | bal. | bal. | bal. | bal. | bal. | bal. | bal. | bal. |
| Y' (%) | 29 | 31 | 32 | 35 | 29 | 34 | 31 | 29 |

The above alloying levels were selected to reflect aluminum levels higher than GTD-222, and titanium levels lower than GTD-222. As a result, the Al/Ti atomic percent ratios of these alloys were drastically different than that of GTD-222 (about 0.91), which U.S. Pat. No. 4,810,467 taught as being a critical aspect in terms of achieving metallurgical stability and other desired properties of the GTD-222 alloy. All of the alloys contained carbon at levels within the teachings of U.S. Pat. No. 4,810,467, but near or below the lower limit of the preferred range (0.08% to 0.12%). Finally, alloys 599 and 624 were formulated to have higher tantalum levels than GTD-222 (about 1%) for the purpose of increasing the gamma prime volume content.

Following heat treatment, the weldability of the alloys was assessed by forming hemispherical indentations of different diameters in some of the slab specimens, and then filling the indentations using standard welding parameters for GTD-222. The filled indentations were then cross-sectioned and examined for weld quality. Two of the alloys, 599 and 624, cracked during welding, and therefore were not further evaluated. The remaining specimens exhibited acceptable weld properties.

Tensile properties of the remaining alloys were determined with standard smooth bar specimens machined from the cast slabs. The data of the three most promising alloys, 597, 601 and 604, are summarized below in Tables II, III and IV, wherein "UTS" is ultimate tensile strength, "YS" is 0.2% yield strength, "EL" is elongation, and "RA" is reduction in area.

TABLE II

| Properties at 70° F. (about 20° C.) | | | | |
|---|---|---|---|---|
| | Alloy No. 597 | Alloy No. 601 | Alloy No. 604 | GTD-222 |
| UTS (ksi) | 108 | 118 | 114 | 137 |
| YS (ksi) | 80 | 85 | 85 | 106 |
| EL (%) | 12.9 | 11.9 | 12.4 | 7.2 |
| RA (%) | 14.4 | 15.1 | 14.5 | 10.7 |

TABLE III

| Properties at 1400° F. (about 760° C.) | | | | |
|---|---|---|---|---|
| | Alloy No. 597 | Alloy No. 601 | Alloy No. 604 | GTD-222 |
| UTS (ksi) | 95 | 102 | 106 | 116 |
| YS (ksi) | 63 | 72 | 76 | 88 |
| EL (%) | 20.1 | 14.5 | 14.9 | 9.2 |
| RA (%) | 22.1 | 18.3 | 19.3 | 12.9 |

TABLE IV

| Properties at 1650° F. (about 900° C.) | | | | |
|---|---|---|---|---|
| | Alloy No. 597 | Alloy No. 601 | Alloy No. 604 | GTD-222 |
| UTS (ksi) | 51 | 56 | 61 | 57 |
| YS (ksi) | 46 | 53 | 54 | 55 |
| EL (%) | 24.8 | 20.6 | 25.5 | 17.0 |
| RA (%) | 69.8 | 46.7 | 59.5 | 36.3 |

In view of alloys 597, 601 and 604 having essential the same level of tantalum as GTD-222, the data in Tables II, III and IV reflect the effect that modified levels of aluminum, titanium and carbon have on the properties of GTD-222. Each of these alloys has the same carbon content (0.06%), which is lower than the preferred range for GTD-222 (0.08 to 0.12%) and believed to improve castability and weldability. Accordingly, the data in Tables II, III, and IV is useful to illustrate the effect that different levels of aluminum and titanium had on tensile properties. A starting point is to examine the tensile properties of the 597 alloy, which had essentially the same aluminum content as the 604 alloy and the same titanium content as the 601 alloy. From Tables I, III and IV, it can be seen that the combined effect of an increased aluminum content and a reduced titanium content was to produce an alloy (597) exhibiting the lowest ultimate tensile strength of the four alloys, yet sufficiently high for third stage nozzles. Alloy 597 also exhibited the lowest yield strength, corresponding to the highest ductility exhibited by the four alloys. Its higher aluminum content should result in alloy 597 having better oxidation resistance than GTD-222.

Alloys 601 and 604 exhibited similar tensile properties, with 604 having slightly higher tensile and yield strength at the elevated test temperatures. Alloy 601 differed from alloy 597 only in aluminum content (3.25% versus 2.22%, respectively), and alloy 604 differed from alloy 597 only in titanium content (1.2% versus 0.65%, respectively), evidencing the similar effect that increasing aluminum and titanium has on the tensile properties of GTD-222. With the same aluminum content, alloy 604 can be expected to have improved oxidation resistance properties similar to alloy 597. With its significantly higher aluminum content, alloy 601 would be expected to exhibit better oxidation resistance than any of the other alloys evaluated in the investigation.

FIG. 1 plots the Larson-Miller Parameter (LMP) versus stress (1000 psi) based on high temperature creep-rupture data collected for alloys 597, 601, 604 and GTD-222 (two specimens and their average). As known in the art, the Larson-Miller Parameter compares stress rupture properties based on the relationship $P=T(C+\log t)\times 10^{-3}$, where P is the time temperature parameter number, T is absolute test temperature in degrees Rankine, t is rupture time in hours, and C is the constant used (e.g., 20). Based on these results, 597 exhibited the lowest creep strength, though again sufficient for third stage nozzles. Extrapolation of this data to zero stress, the alloys were ranked, highest to lowest, on the basis of rupture time as follows: alloy 601, GTD-222, alloy 604 and then alloy 597. On this basis, alloy 601 would appear to have a level of creep strength desirable for the more demanding operating environment of a second stage nozzle, while alloy 597 would have a level of creep strength suitable for the less severe operating environment of a third stage nozzle. The enhanced oxidation resistance discussed above for alloy 601 should be an additional advantage in the higher temperature environment of turbine second stage. Metallurgical examination of the tested specimens evidenced that none of the alloys exhibited any precipitation of unwanted phases, and therefore each was concluded to be metallurgically stable.

On the basis of the above, two nickel-base alloys based on alloys 601 and 597 are believed to be well suited for nozzles of the second and third turbine stages, respectively, of a gas turbine engine. These alloys, designated alloy A and alloy B, respectively, are summarized in Table V below in terms of approximate weight percent for the alloying constituents, as well as gamma prime content.

TABLE V

| | Alloy A Broad | Alloy A Pref. | Alloy A Nom. | Alloy B Broad | Alloy B Pref. | Alloy B Nom. |
|---|---|---|---|---|---|---|
| Co | 10–25 | 18–20 | 19 | 10–25 | 18–20 | 19 |
| Cr | 20–28 | 22.2–22.8 | 22.5 | 20–28 | 22.2–22.8 | 22.5 |
| W | 1–3 | 1.8–2.2 | 2 | 1–3 | 1.8–2.2 | 2 |
| Al | 2.8–3.8 | 3.0–3.5 | 3.25 | 1.6–2.8 | 2.0–2.4 | 2.2 |
| Ti | 0.4–1.5 | 0.55–0.75 | 0.65 | 0.4–1.5 | 0.55–0.75 | 0.65 |
| Al + Ti | 3.0–5.0 | 3.6–4.2 | 3.9 | 1.8–4.3 | 2.5–3.2 | 2.9 |
| Cb | 0.5–1.5 | 0.7–1.45 | 0.8 | 0.5–1.5 | 0.7–1.45 | 0.8 |
| Ta | 0.5–1.5 | 0.9–1.1 | 1.0 | 0.5–1.5 | 0.9–1.1 | 1.0 |
| B | 0.001–0.025 | 0.005–0.015 | 0.01 | 0.001–0.025 | 0.005–0.015 | 0.01 |
| Zr | 0.05 max | 0.005–0.02 | 0.01 | 0.005 max | 0.005–0.02 | 0.01 |
| C | 0.02–0.15 | 0.04–0.1 | 0.06 | 0.02–0.15 | 0.04–0.1 | 0.06 |
| Ni | bal. | bal. | bal. | bal. | bal. | bal. |
| Y' (%) | 30–43 | 33–37 | 35 | 22–36 | 27–30 | 29 |

The alloys identified above in Table V can be satisfactorily heat treated using the treatment described above, though conventional heat treatments adapted for nickelalloys could also be used.

While the invention has been described in terms of a preferred embodiment, it is apparent that other forms could be adopted by one skilled in the art. Therefore, the scope of the invention is to be limited only by the following claims.

What is claimed is:

1. A castable weldable nickel-base alloy consisting of, by weight, about 10% to about 25% cobalt, about 20% to about 28% chromium, about 1% to about 3% tungsten, about 1.6% to about 3.8% aluminum, about 0.4% to about 1.5% titanium, where the sum of aluminum and titanium is about 1.8% to about 5.0%, about 0.5% to about 1.5% columbium, 0.5% to about 1.5% tantalum, about 0.001% to about 0.025% boron, about 0.05% maximum zirconium, about 0.02% to about 0.15% carbon, with the balance nickel and incidental impurities.

2. The alloy according to claim 1, wherein the alloy contains 1.6 to 2.8 weight percent aluminum.

3. The alloy according to claim 2, wherein the sum of the aluminum and titanium content is 1.8 to 4.3 weight percent.

4. The alloy according to claim 1, wherein the alloy contains 2.8 to 3.8 weight percent aluminum.

5. The alloy according to claim 4, wherein the sum of the aluminum and titanium content is 3.0 to 5.0 weight percent.

6. The alloy according to claim 1, wherein the alloy has been solution heat treated at about 1150° C. for about four hours, quenched to below about 700° C., and then aged at about 800° C. for about eight hours.

7. The alloy according to claim 1, wherein the alloy contains about 22 to about 43 volume percent of a gamma-prime precipitate phase.

8. The alloy according to claim 1, wherein the alloy is in the form of a cast nozzle of a gas turbine engine.

9. The alloy according to claim 8, wherein the alloy contains 2.8 to 3.8 weight percent aluminum, and the nozzle is installed in a second turbine stage of the gas turbine engine.

10. The alloy according to claim 8, wherein the alloy contains 1.6 to 2.8 weight percent aluminum, and the nozzle is installed in a third turbine stage of the gas turbine engine.

11. A castable weldable nickel-base alloy consisting of, by weight, 18.5% to 19.5% cobalt, 22.2% to 22.8% chromium, 1.8% to 2.2% tungsten, 2.0% to 2.4% aluminum, 0.55% to 0.75% titanium, the sum of aluminum and titanium being 2.5% to 3.2%, 0.7% to 1.45% columbium, 0.9% to 1.1% tantalum, 0.005% to 0.015% boron, 0.005% to 0.02% zirconium, 0.04% to 0.10% carbon, with the balance nickel and incidental impurities.

12. The alloy according to claim 11, wherein the alloy is in the form of a cast nozzle of a gas turbine engine.

13. The alloy according to claim 12, wherein the nozzle is installed in a third turbine stage of the gas turbine engine.

14. The alloy according to claim 11, wherein the alloy contains, by weight, about 19% cobalt, about 22.5% chromium, about 2% tungsten, about 2.2% aluminum, about 0.65% titanium, about 0.8% columbium, about 1% tantalum, about 0.01% boron, about 0.01% zirconium, about 0.06% carbon, with the balance essay nickel and incidental impurities.

15. The alloy according to claim 14, wherein the alloy is in the form of a cast nozzle installed in a third turbine stage of the gas turbine engine.

16. A castable weldable nickel-base alloy consisting of, by weight, 18.5% to 19.5% cobalt, 22.2% to 22.8% chromium, 1.8% to 2.2% tungsten, 3.0% to 3.5% aluminum, 0.55% to 0.75% titanium, the sum of aluminum and titanium being 3.6% to 4.2%, 0.7% to 1.45% columbium, 0.9% to 1.1% tantalum, 0.005% to 0.015% boron, 0.005% to 0.02% zirconium, 0.04% to 0.10% carbon, with the balance nickel and incidental impurities.

17. The alloy according to claim 16, wherein the alloy is in the form of a cast nozzle of a gas turbine engine.

18. The alloy according to claim 17, wherein the nozzle is installed in a second turbine stage of the gas turbine engine.

19. The alloy according to claim 16, wherein the alloy contains, by weight, about 19% cobalt, about 22.5% chromium, about 2% tungsten, about 3.25% aluminum, about 0.65% titanium, about 0.8% columbium, about 1% tantalum, about 0.01% boron, about 0.01% zirconium, about 0.06% carbon, with the balance nickel and incidental impurities.

20. The alloy according to claim 19, wherein the alloy is in the form of a cast nozzle installed in a second turbine stage of the gas turbine engine.

* * * * *